US005364249A

United States Patent [19]

Link

[11] Patent Number: 5,364,249

[45] Date of Patent: Nov. 15, 1994

[54] ROTARY STEAM ENGINE HAVING ROTOR SIDE PLATES

[76] Inventor: Donald M. Link, 4881 Lake Cecile Dr., Kissimmee, Fla. 34746

[21] Appl. No.: 142,857

[22] Filed: Oct. 28, 1993

[51] Int. Cl.[5] ..... F01C 1/08

[52] U.S. Cl. ..... 418/191; 418/140

[58] Field of Search ..... 418/191, 227, 140, 142, 418/144

[56] References Cited

U.S. PATENT DOCUMENTS

| | | | |
|---|---|---|---|
| 866,808 | 9/1907 | Poulton | 418/191 |
| 3,620,655 | 11/1971 | Arnegard | 418/191 |
| 4,202,315 | 5/1980 | Lutrat | 418/191 |
| 4,464,102 | 8/1984 | Eiermann | 418/179 |

*Primary Examiner*—Richard A. Bertsch
*Assistant Examiner*—Charles G. Freay

[57] ABSTRACT

A rotary steam engine has a working chamber (14), with first and second cylindrical rotors (1,2) mounted in overlapping cylindrical chamber portions (26, 27) for rotation about respective parallel axes (24, 25), connected by gears (18) for synchronized rotation. The first rotor (1) has at least one pusher (21) extending radially outward of the first rotor's circumferential surface, and the second rotor's circumferential surface has a corresponding at least one indenture (22) shaped to receive the pusher (21) during rotation of the two rotors (1, 2) . Side plates (4) attached to the first rotor (1) for rotation with the first rotor (1), press against spring-loaded seals (34) and the second rotor (2) to provide improved sealing with minimum wear.

2 Claims, 3 Drawing Sheets

ROTARY STEAM ENGINE HAVING ROTOR SIDE PLATES

The present invention relates to a rotary engine operable as a power source motivated by the use of steam under pressure.

BACKGROUND OF THE INVENTION

A great advantage of the rotary steam engine is that the steam can be generated by a number of fuels, and preferably by those that create little or no pollution.

Rotary engines of the type to which the present invention relates are described, for example, in U.S. Pat. No. 866,808. They comprise a housing formed with an inner chamber having at least two overlapping, parallel-axis cylindrical portions, each with a shaft passing therethrough. On one shaft there is a cylindrical drive rotor which is provided with a radially outwardly extending piston tooth or projection, and which forms an annular working chamber with the housing wall surrounding it. On the other shaft, which rotates in the opposite direction, there is provided a cylindrical abutment rotor which runs along the housing wall and rides on the working rotor. The abutment rotor has a radially inwardly directed recess or indenture for the passage of the piston tooth or projection therethrough. Steam entering the annular working chamber at a steam inlet port moves the projection to rotate the drive rotor, and exits through an exhaust port formed in the wall of the chamber. The abutment rotor recess receives the drive rotor projection as the projection approaches the abutment rotor and permits it to pass the same. Rolling engagement between the cylindrical surfaces of the drive and abutment rotors prevents the steam from completing a circle of revolution within the annular working chamber. Sealing between the rotors and the casing is achieved by side plates that bolt to the casing to close the chamber cylindrical portion ends. Frictional contact between the moving rotor parts and the side plates subjects the drive rotor to considerable wear and is a major source of steam leakage.

Other prior art arrangements of interest are disclosed in U.S. Pat. Nos. 3,620,655; 4,202,315; and 4,464,102.

SUMMARY OF THE INVENTION

It is an object of the present invention to provide improvements in rotary engines that reduce wear due to frictional contact and minimize leakage between working ports.

In accordance with the invention, a rotary steam engine has a chamber therein, with first and second cylindrical rotors mounted in overlapping cylindrical chamber portions for rotation about respective parallel axes, connected by gears for synchronized rotation. The first rotor has at least one pusher extending radially outward of the first rotor's circumferential surface, and the second rotor's circumferential surface has a corresponding at least one indenture shaped to receive the pusher during rotation of the two rotors. Side plates attached to the first rotor press against seals and the second rotor which is sealed by seals in bearing plates which surround the chamber. Steam under pressure enters an intake port into the sealed housing and is exited out the side of the pusher. This creates an opposite but equal reaction, and builds pressure in an enclosed annular working chamber defined between the first rotor and its corresponding cylindrical chamber portion, causing the first and second rotors to rotate, and forcing the lower pressure out through an exhaust port, thereby creating a continuous rotary operation.

BRIEF DESCRIPTION OF THE DRAWINGS

Embodiments of the invention have been chosen for purposes of illustration, and are described with reference to the accompanying drawings, wherein.

Throughout the drawings, like elements are referred to by like

DETAILED DESCRIPTION OF PREFERRED EMBODIMENTS

Figure 1:
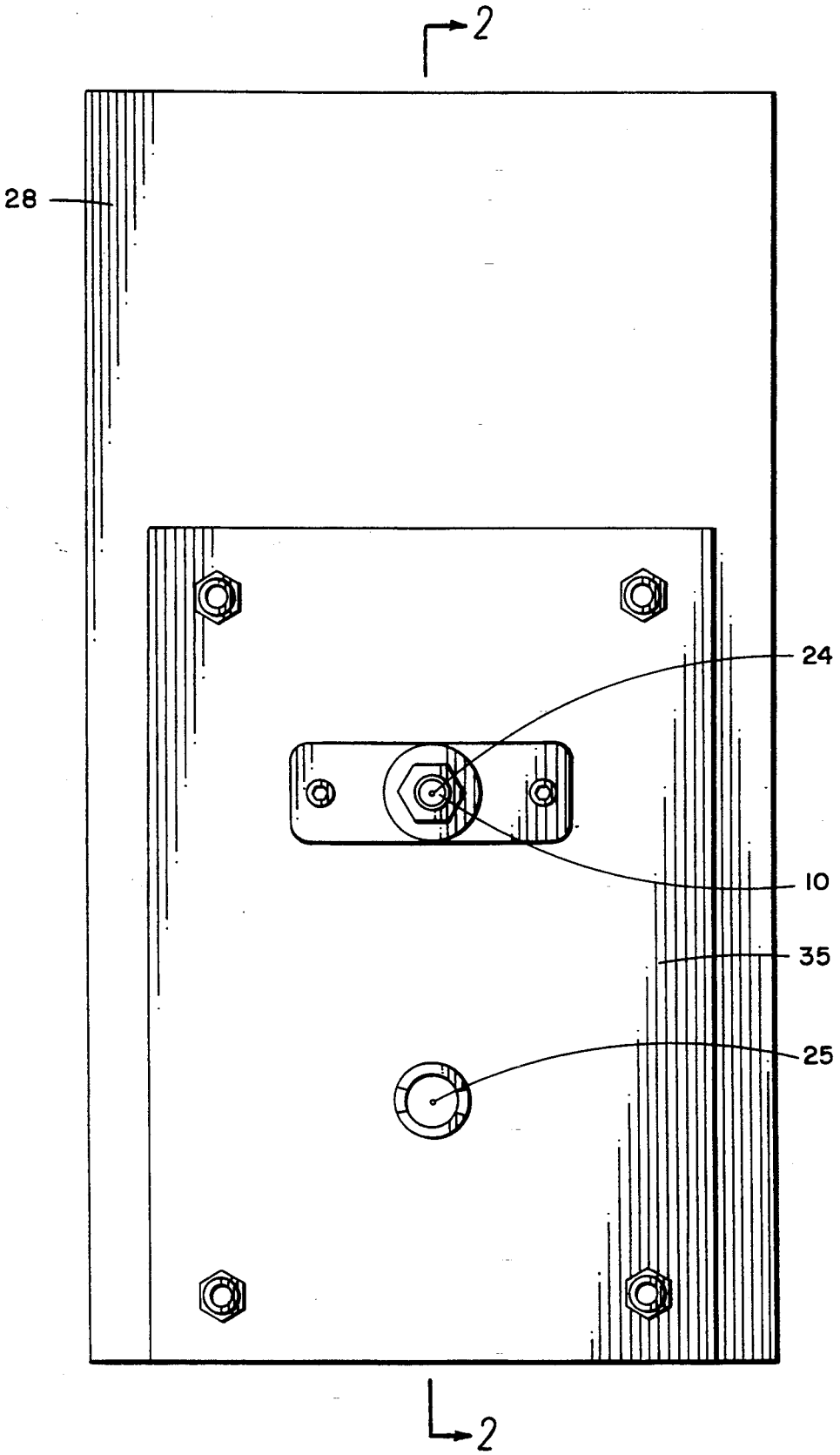
FIG. 1 is a front plan view of a rotary engine incorporating improvements in accordance with the principles of the invention.
Figure 2:
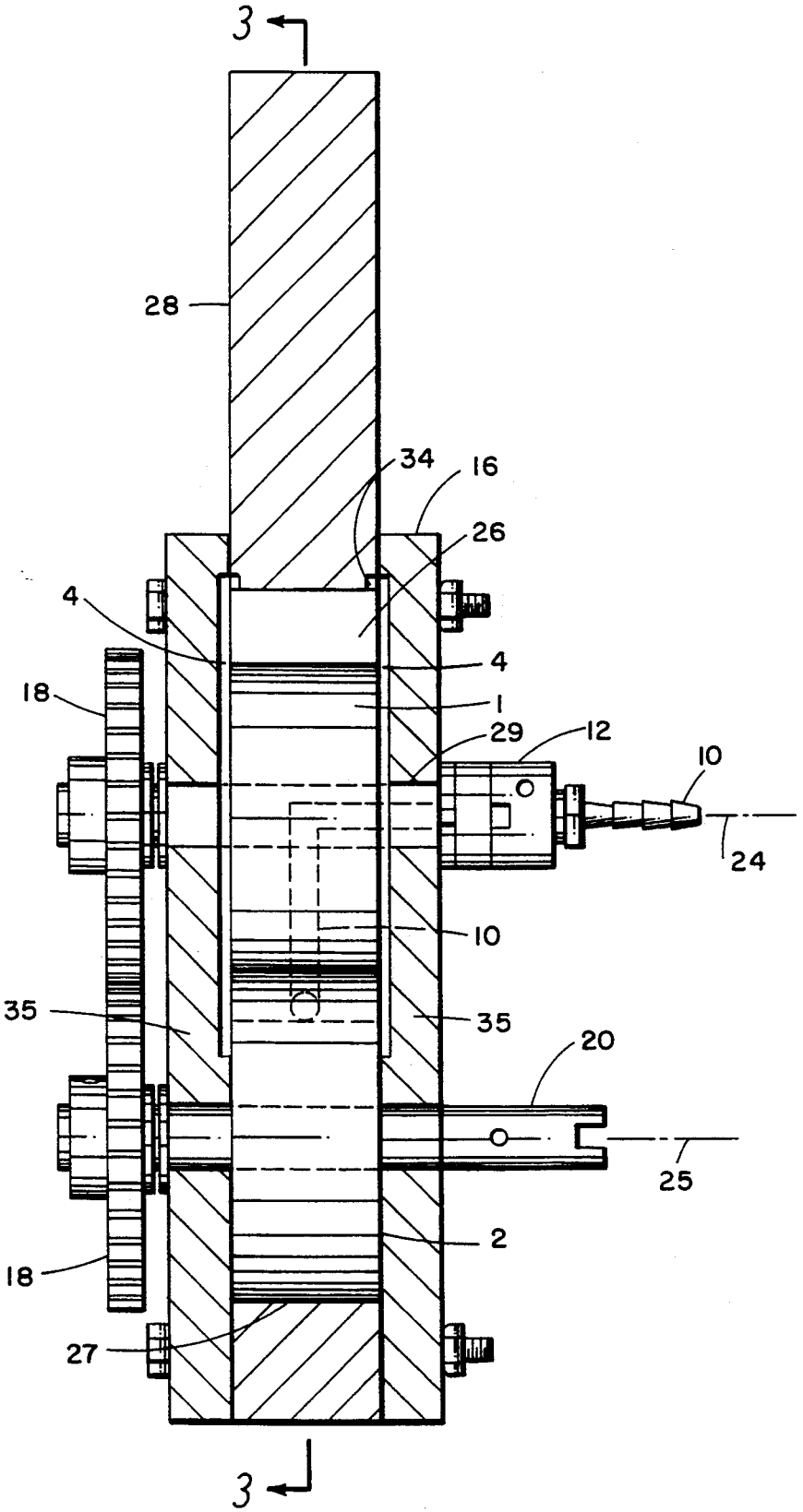
FIG. 2 is a vertical lateral section view of the engine of FIG. 1, taken along the line 2—2 of FIG. 1.
Figure 3:
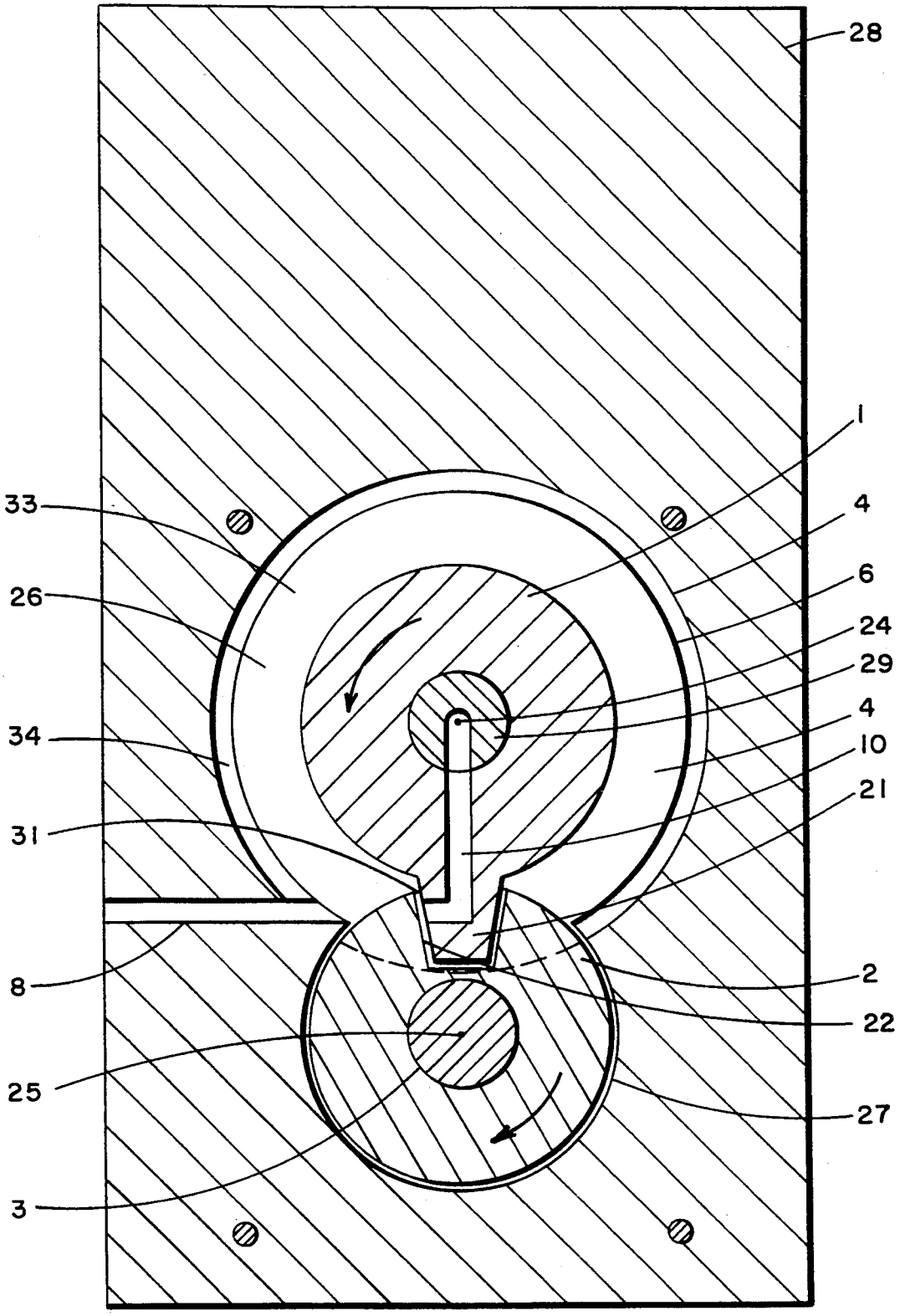
FIG. 3 is a vertical longitudinal section view of the same engine taken along the line 3—3 of FIG. 2.

As shown in FIGS. 1–3, a steam engine, in accordance with the invention, is comprised of two identically-sized cylindrical rotors located within respective overlapping, parallel axis cylindrical chambers 26, 27 formed in an inner chamber of a housing 28. The drive rotor 1 has a radially outwardly extending protrusion 21, called a "pusher" (FIG. 3). The abutment rotor 2 has a radially inwardly directed recess or indenture 22 synchronized with the pusher 21. The rotors 1, 2 are synchronized by meshing gears 18 (FIG. 2), and rotate on parallel axes 24, 25, on shafts supported by bearings. The drive rotor 1 can be constructed with more than one pusher, and with corresponding extra rotors with indentures synchronized to the pushers. The engine should be balanced for smooth running.

The rotors 1, 2 press together with their cylindrical surfaces in rolling engagement, and the pusher and indenture are dimensioned, configured and adapted so that the pusher is received within the indenture during rotation of the rotors 1, 2. Rotors 1, 2 fit their respective cylindrical chamber portions 26, 27 with just enough clearance to enable the outside diameters of portion 21 and the cylindrical surface of rotor 2 to roll freely along the inside diameters of the cylindrical chamber walls. In conventional manner, an annular working chamber 33 is provided between the outside cylindrical surface of rotor 1 (not including the pusher 2) and the inside diameter of chamber portion 26.

A steam intake port 10 is provided through the drive shaft 29 of rotor 1, and out through a trailing edge side 31 of pusher 21. Steam is contained at the drive shaft by a ceramic or other suitable seal 12. This seal 12 can be similar to that used in a water pump.

A steam exhaust port 8 is provided through the cylindrical wall of chamber portion 26, and located where pusher 21 meets indenture 22, during rotation as indicated. The exhaust can be condensed and recycled.

Circular side plates 4 are coaxially attached to respective end faces of drive rotor 1. Plates 4 travel in rotation with rotor 1 and have diameters that extend beyond the outside diameter of chamber portion 26. Plates 4 overlap chamber portion 27 and ]rotor 2 as indicated in FIG. 2 and by the dashed line in FIG. 3. Spring-loaded seals 34 (FIGS. 2 and 3), disposed circumferentially of chamber portion 26 on casing 28 as shown, make contact at the outer peripheral edges of the inside surfaces of side plates 4 of rotor 1, and similar seals in the bearing plates 35 which close the sides of rotor 2, make contact with the outside surfaces of the circular end faces of rotor 2.

The parallel axes may, if desired, be splined at the rotors 1, 2 and gears 18 to ensure synchronization, and the gears 18 can be enclosed, vented, and bathed in oil.

To vary the power of the engine, other than controlling the steam volume and pressure, the rotors 1, 2 can be made wider or larger in diameter.

In operation, steam under pressure enters the hollow of shaft 29 of rotor 1 axially and is ejected out the trailing edge side 31 of pusher 21. The steam creates an opposite but equal reaction on pusher 31, and serves to build up pressure in the enclosed working chamber 33, thereby causing the synchronized rotors 1, 2 to rotate. The lower pressure on the opposite side of pusher 31 is exhausted through the exhaust port 8, creating a continuous rotary operation.

A prototype of the invention has been constructed and found to perform most satisfactorily.

I claim:

1. In a rotary steam engine including a housing having a chamber wall defining an inner working chamber therein, first and second rotors mounted in the chamber for rotation about respective parallel axes and having respective circumferential surfaces and opposite faces, and means for synchronizing rotation between said rotors, with said first rotor having at least one pusher extending radially outwardly of said first rotor circumferential surface, and said second rotor circumferential surface having at least one indenture shaped to receive said pusher during rotation of said first and second rotors, the improvement comprising said engine further having:

seals located at said chamber wall;

side plates respectively attached to said opposite faces of said first rotor, said side plates pressing against said opposite faces of said second rotor and against said seals at said chamber wall;

an intake for directing steam through said first rotor and out of said pusher; and an exhaust for discharging steam from said working chamber.

2. A rotary steam engine, comprising:

a housing formed with an inner chamber having a chamber wall defining at least two overlapping, parallel axis cylindrical portions; said chamber wall including a steam exhaust port;

shafts respectively passing through each chamber portion;

a cylindrical drive rotor mounted on one of said shafts and disposed within one of said chamber portions, said drive rotor including opposite faces and a radially outwardly extending pusher which forms an annular working chamber with said chamber wall; said pusher including a trailing edge surface having a steam inlet port;

a cylindrical abutment rotor mounted on the other of said shafts and disposed within the other of said chamber portions, said abutment rotor including opposite faces and a radially inwardly directed recess, said recess being dimensioned, configured and adapted for passage of said pusher therethrough during rotation of said drive and abutment rotors;

mean for delivering steam from outside said housing to said annular working chamber through said steam inlet port;

means for delivering steam from said annular working chamber through said steam exhaust port outside said housing;

means for rotating said shafts for synchronized rotation of said drive and abutment rotors;

seals mounted on said housing at said chamber wall; and side plates respectively attached to said drive rotor opposite faces and disposed to press against said seals and said abutment rotor opposite faces during rotation of said drive and abutment rotors.

* * * * *